US007318754B1

(12) United States Patent
Vaden et al.

(10) Patent No.: US 7,318,754 B1
(45) Date of Patent: Jan. 15, 2008

(54) KEYED MODULAR CONNECTION SYSTEM AND ASSOCIATED ADAPTER CABLE

(75) Inventors: Sterling Vaden, Black Mountain, NC (US); Derrick F. Stikeleather, Swannanoa, NC (US); William R. Reynolds, Asheville, NC (US); Sumio Seo, South Wallingford, VT (US); William B. Everette, Asheville, NC (US)

(73) Assignee: Superior Modular Products Incorporated, Swannanoa, NC (US)

( * ) Notice: Subject to any disclaimer, the term of this patent is extended or adjusted under 35 U.S.C. 154(b) by 0 days.

(21) Appl. No.: 11/517,827

(22) Filed: Sep. 8, 2006

(51) Int. Cl.
*H01R 24/00* (2006.01)

(52) U.S. Cl. ..... 439/676; 439/502

(58) Field of Classification Search ..... 439/676, 439/680, 502
See application file for complete search history.

(56) References Cited

U.S. PATENT DOCUMENTS

| | | | |
|---|---|---|---|
| 4,376,565 | A | 3/1983 | Bird et al. |
| 4,781,626 | A | 11/1988 | Lazarchik |
| 5,125,852 | A | 6/1992 | Archer |
| 5,370,556 | A | 12/1994 | Olsson |
| 5,538,438 | A | 7/1996 | Orlando |
| 6,017,229 | A | 1/2000 | Tulley et al. |
| 6,517,377 | B2 | 2/2003 | Vaden |
| 6,663,419 | B2 | 12/2003 | Vaden |
| 6,821,159 | B2 | 11/2004 | Munger, Jr. et al. |
| 6,852,386 | B2 | 2/2005 | Nadezhdin et al. |
| 6,960,025 | B2 | 11/2005 | Gurreri |
| 2001/0005652 | A1 | 6/2001 | Brownell et al. |
| 2005/0117850 | A1 | 6/2005 | Milette |
| 2005/0176308 | A1 | 8/2005 | Gurreri |

*Primary Examiner*—Khiem Nguyen
(74) *Attorney, Agent, or Firm*—Cartel & Schnedler, P.A.

(57) ABSTRACT

A keyed modular connection system including a nonstandard wiring configuration, a plug wired in the preselected nonstandard wiring configuration and including exterior surfaces that define plug recesses, a jack wired in the preselected nonstandard wiring configuration and including interior surface that define jack recesses, plug protrusions extending from the external surfaces of the plug and configured to be received by the jack recesses when the plug is inserted into the jack, jack protrusions extending from the internal surfaces of the jack and configured to be received by the plug recesses when the plug is inserted into the jack, and when a plug not wired in the preselected nonstandard wiring configuration is attempted to be inserted into the jack, the jack protrusions prevent the attempted insertion, and when the plug is attempted to be inserted into a jack not wired in the preselected nonstandard wiring configuration, the plug protrusions prevent the attempted insertion.

13 Claims, 10 Drawing Sheets

KEYED MODULAR CONNECTION SYSTEM AND ASSOCIATED ADAPTER CABLE

CROSS-REFERENCE TO RELATED APPLICATIONS

Not Applicable

DETAILED DESCRIPTION OF THE INVENTION

Figure 1:
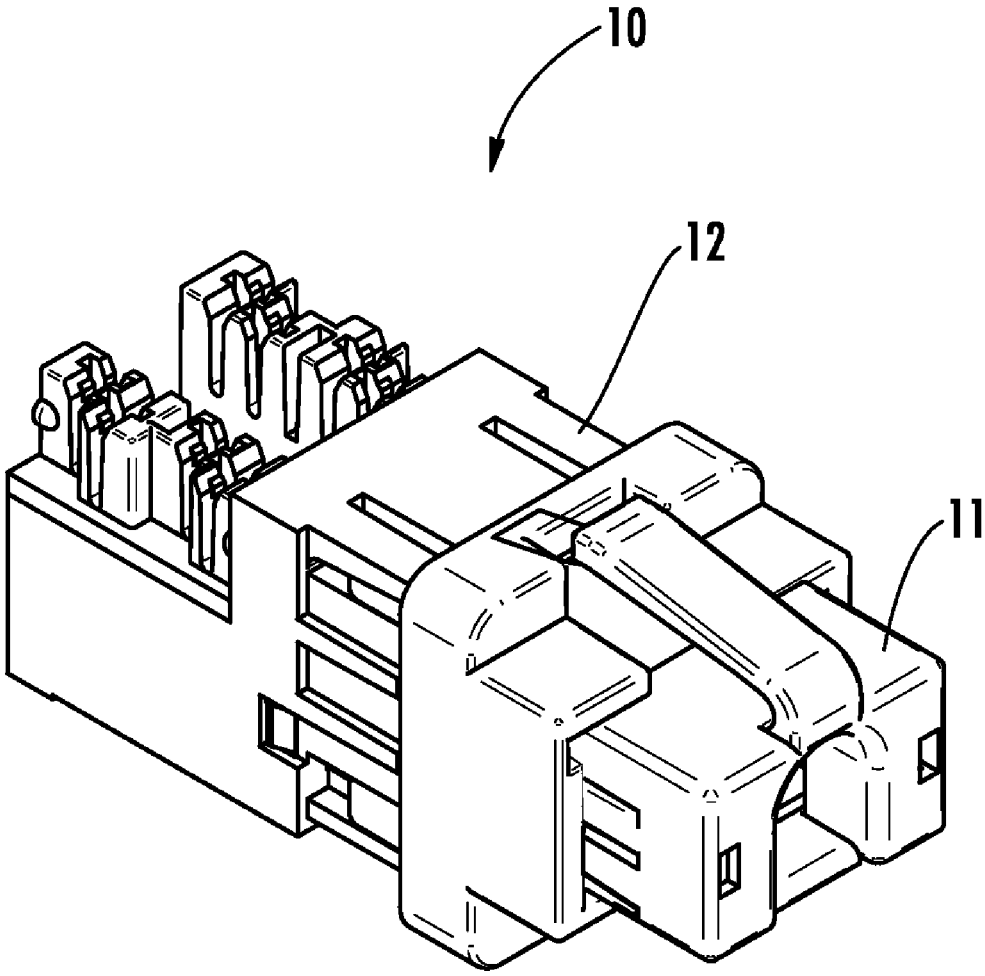
FIG. 1 is a perspective view of a first embodiment of a keyed modular connection system according to the invention, shown fully assembled and with the plug inserted into the jack.
Figure 2:
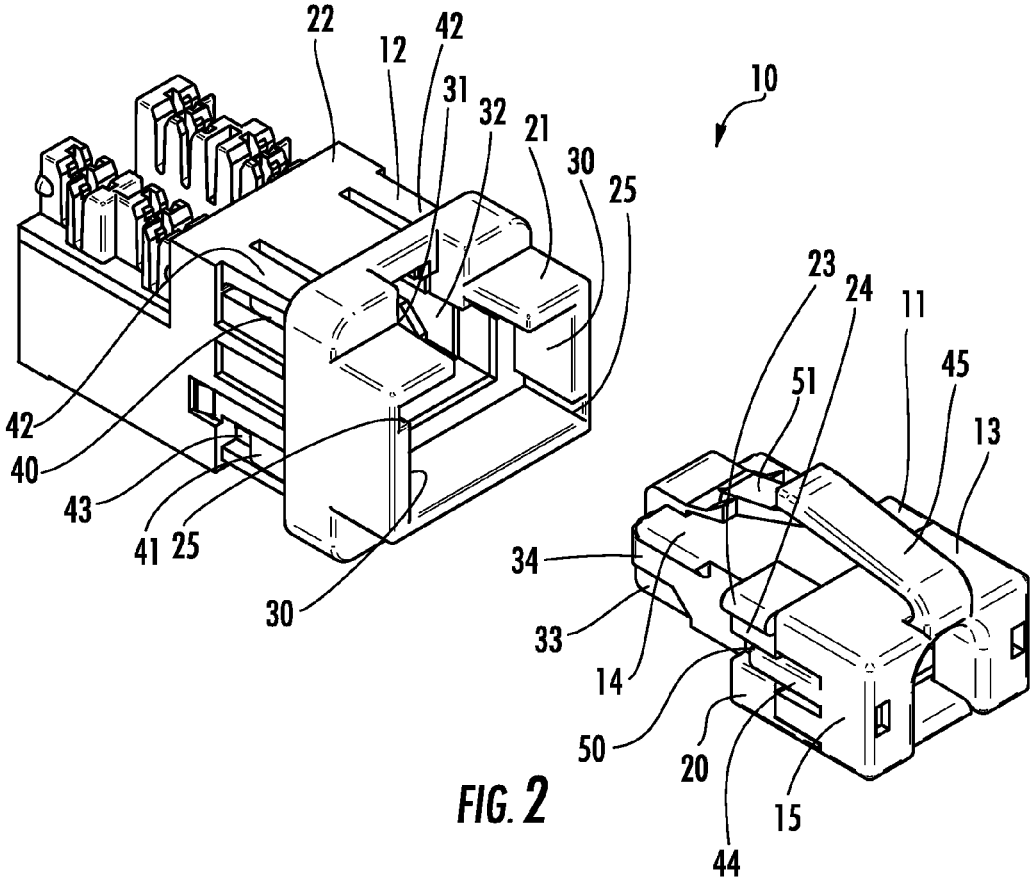
FIG. 2 is a perspective view of the connection system shown in FIG. 1, with the plug and jack separated from one another.
Figure 4:
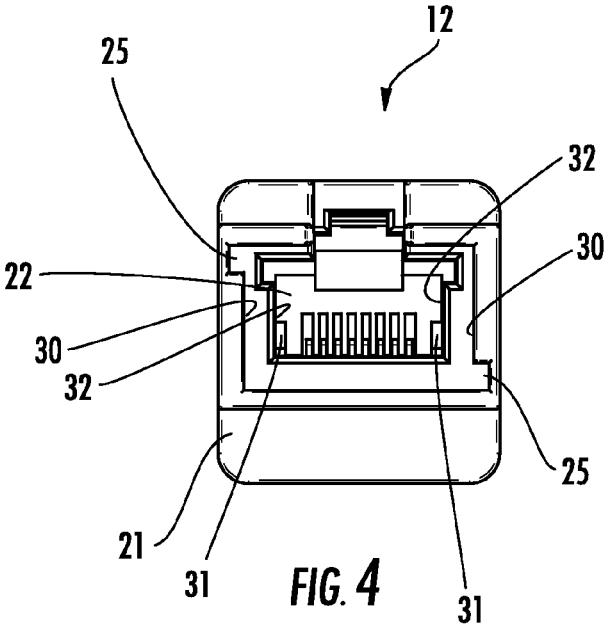
FIG. 4 is an end elevational view into the plug-receiving port of the jack shown in FIGS. 1 and 2.
Figure 3:
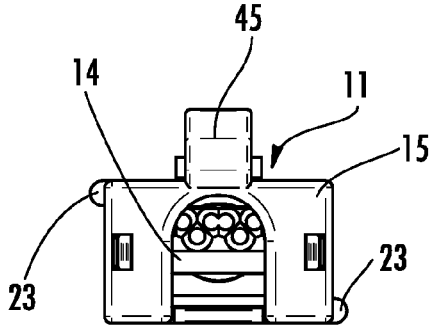
FIG. 3 is an end elevational view into the cable-receiving port of the plug shown in FIGS. 1 and 2.
Figure 5:
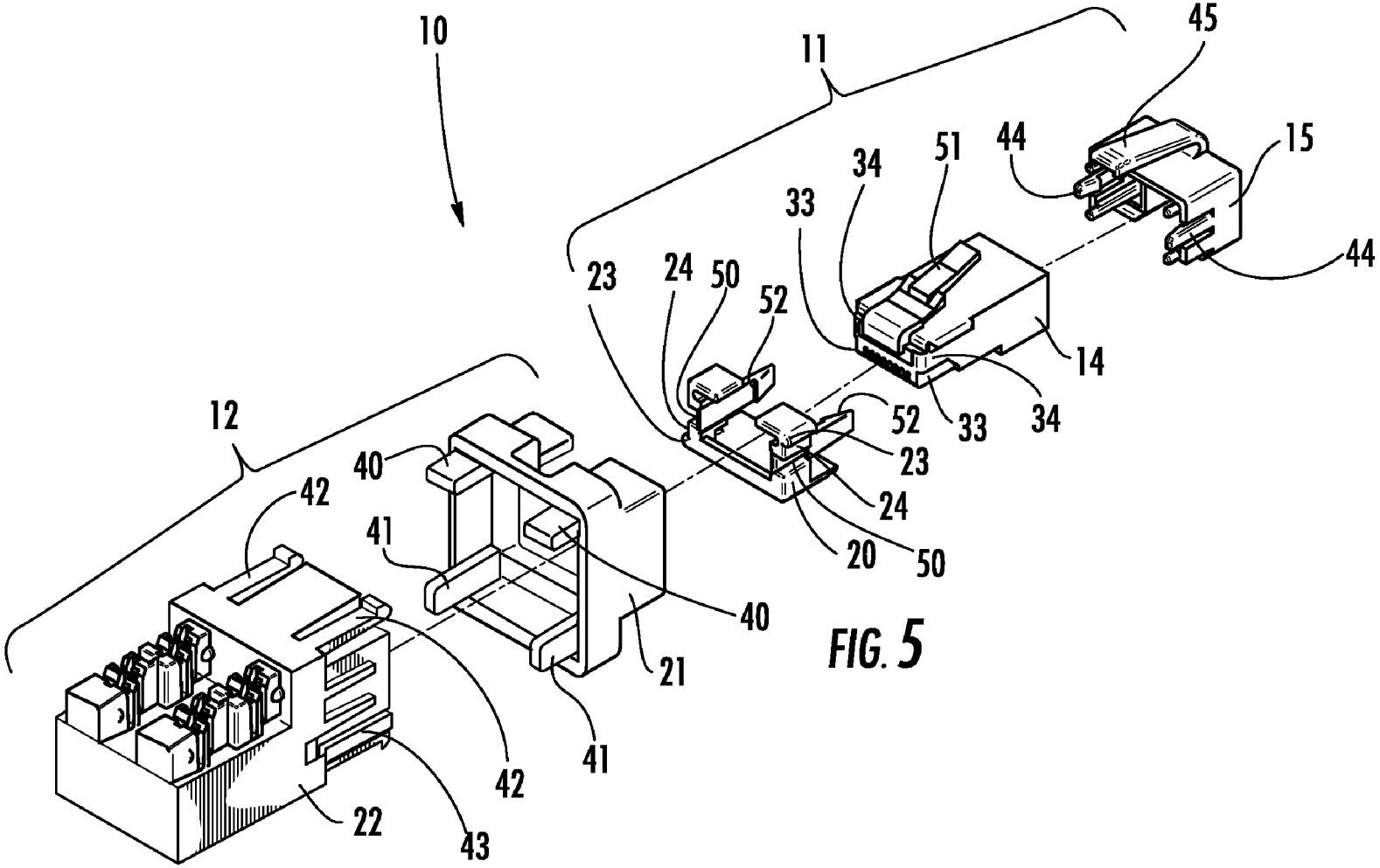
FIG. 5 is an exploded view of the connection system shown in FIGS. 1 and 2.
Figure 6:
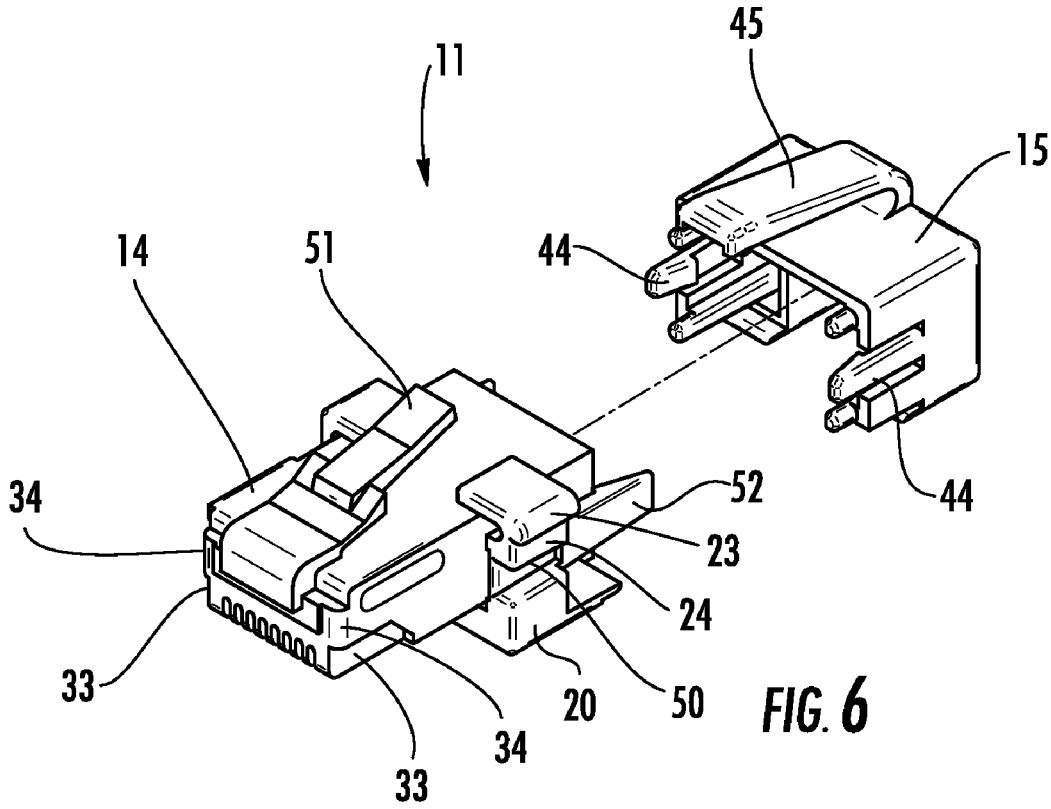
FIG. 6 is a perspective view of the plug shown in FIGS. 1 and 2 with the cap portion of the attachment separated from the remainder of the plug.
Figure 7:
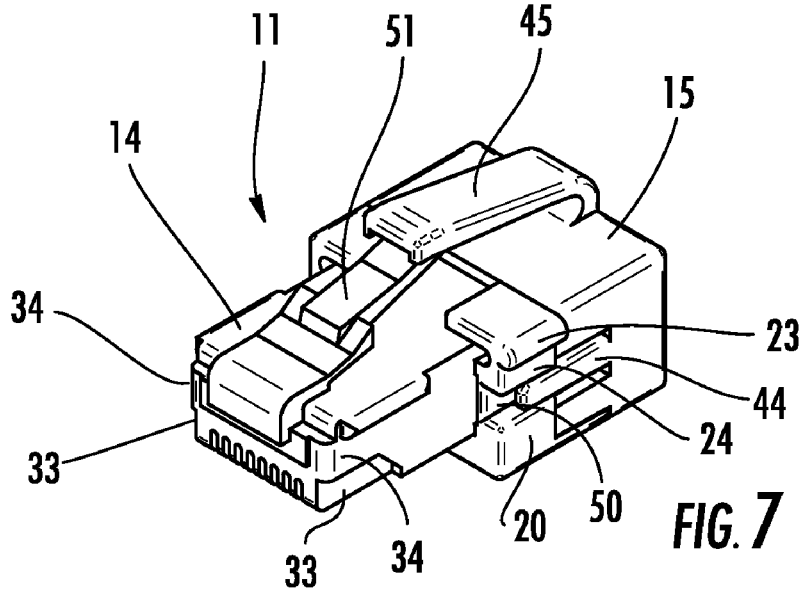
FIG. 7 is a perspective view of the plug shown in FIGS. 1 and 2 as it appears when fully assembled.
Figure 8:
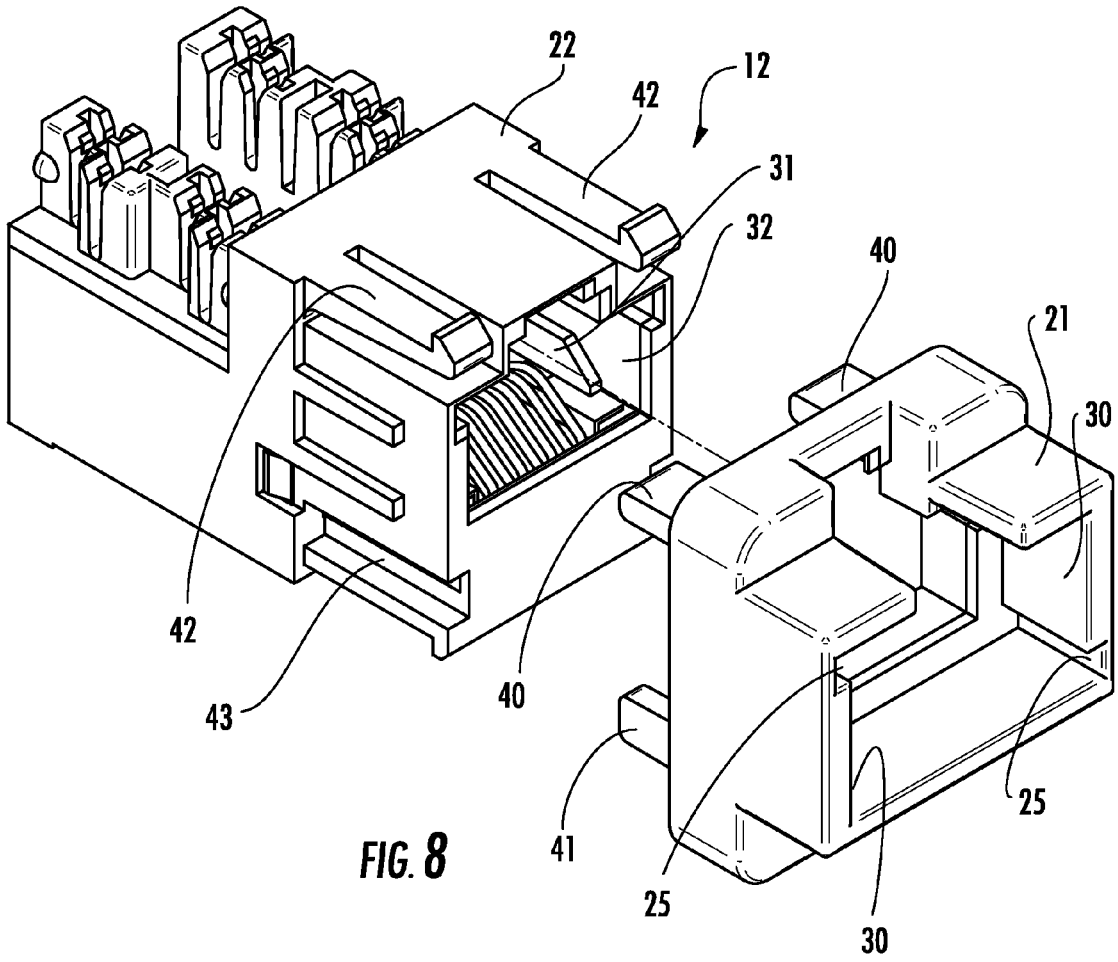
FIG. 8 is an exploded view of the jack shown in FIGS. 1 and 2.
Figure 9:
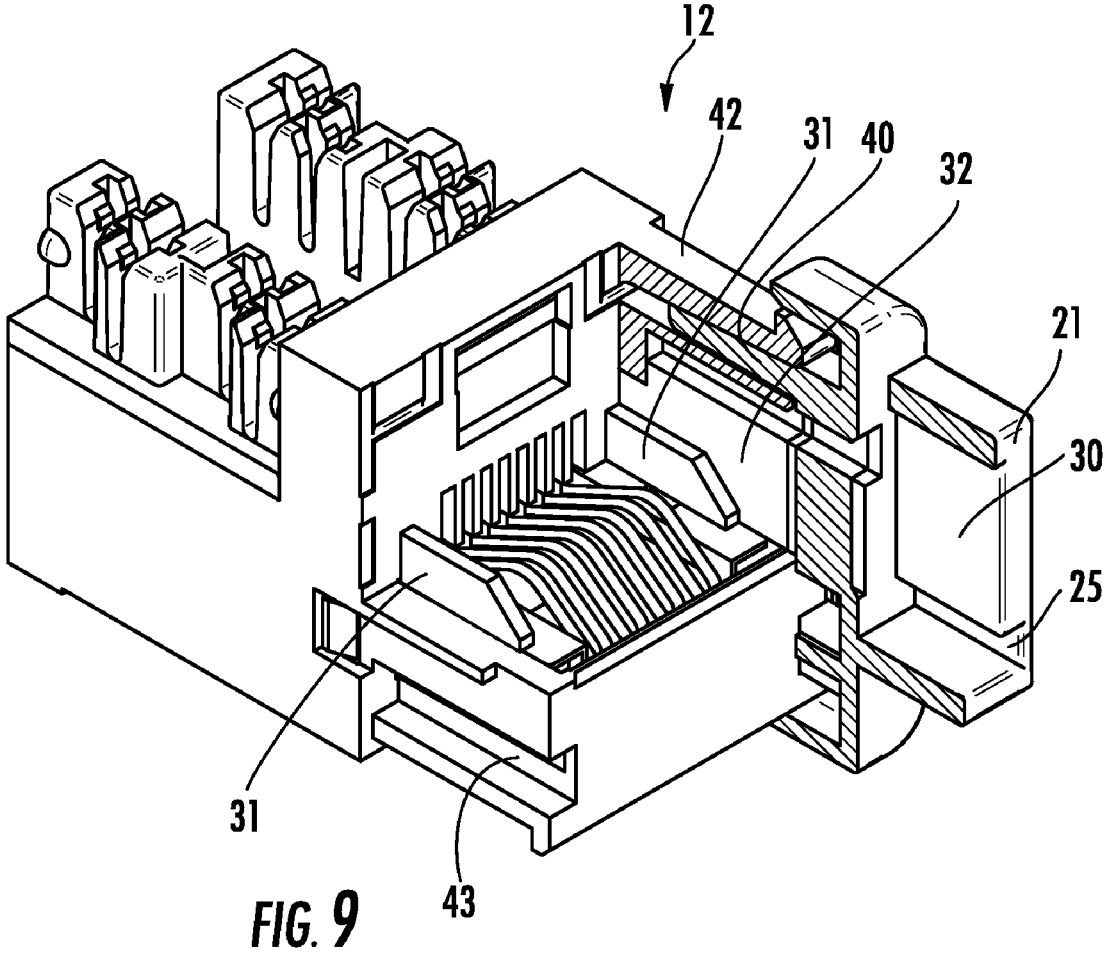
FIG. 9 is a partially cutaway view of the fully assembled jack shown in FIGS. 1 and 2.

A first embodiment of a keyed modular connection system according to the invention is broadly shown fully assembled in FIG. 1 at reference numeral 10. The connection system 10 includes a fully assembled plug 11 and a fully assembled jack 12. FIG. 2 illustrates the fully assembled plug 11 and the fully assembled jack 12 separated from one another, and FIGS. 3 through 9 illustrate further views of the first embodiment of the keyed modular connection system 10 of the invention or components thereof.

The plug 11 comprises an attachment 13 mounted on a plug body 14, and the jack 12 comprises a bezel 21 mounted on a jack body 22. The attachment 13 of the plug 11 comprises a cap 15 and a sleeve 20 for receiving the cap 15. Sleeve protrusions 23 extend from exterior surfaces 24 of the sleeve 20 of the plug 11. Bezel recesses 25 for receiving the sleeve protrusions 23 are defined by interior surfaces 30 of the bezel 21 of the jack 12. Jack body protrusions 31 extend from interior surfaces 32 (FIG. 9) of the jack body 22. Plug body recesses 33 for receiving the jack body protrusions 31 are defined by exterior surfaces 34 of the plug body 14.

Figure 10:
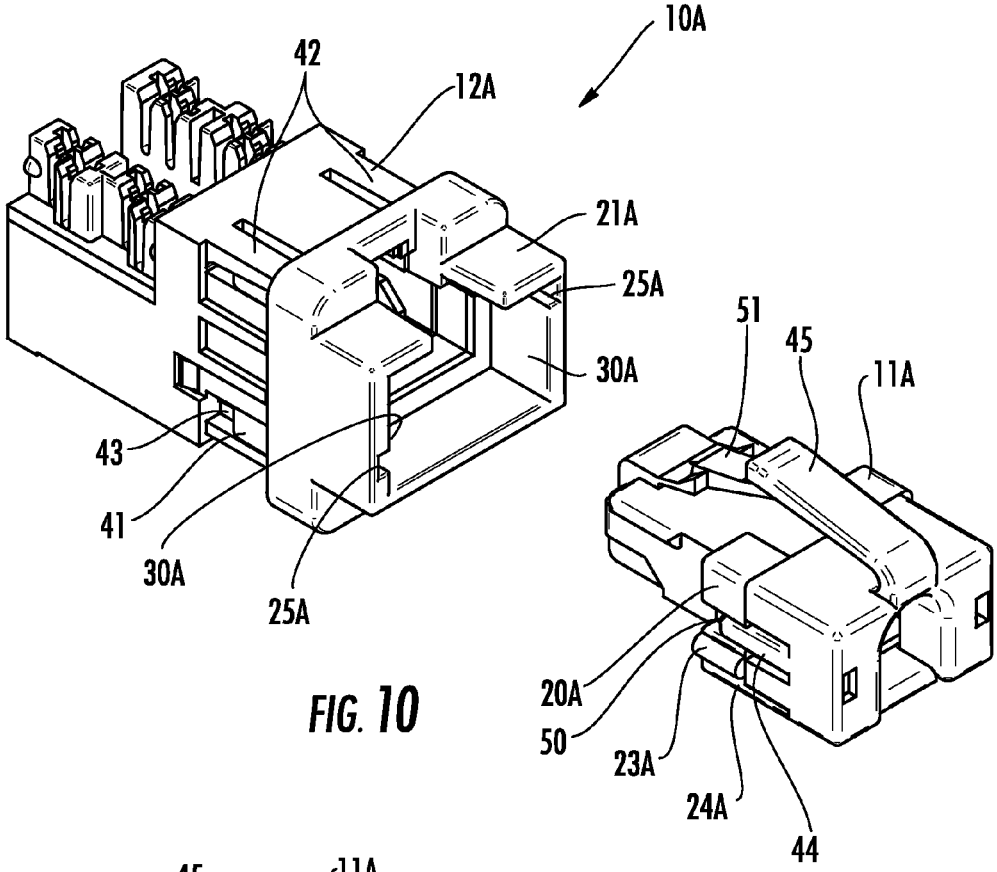
FIG. 10 is a perspective view of a second embodiment of a keyed modular connection system according to the invention, shown fully assembled and with the plug and jack separated from one another.
Figure 11:
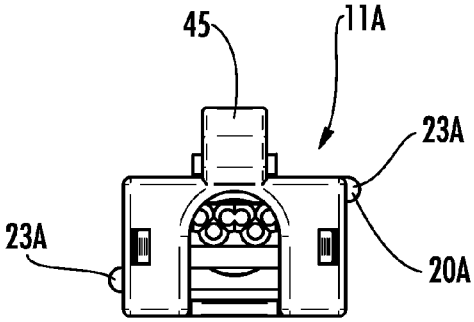
FIG. 11 is an end elevational view into the cable-receiving port of the plug shown in FIG. 10.
Figure 12:
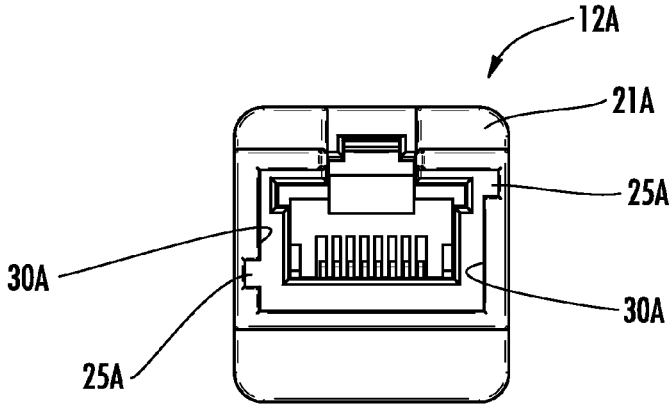
FIG. 12 is an end elevational view into the plug-receiving port of the jack shown in FIG. 10.
Figure 13A:
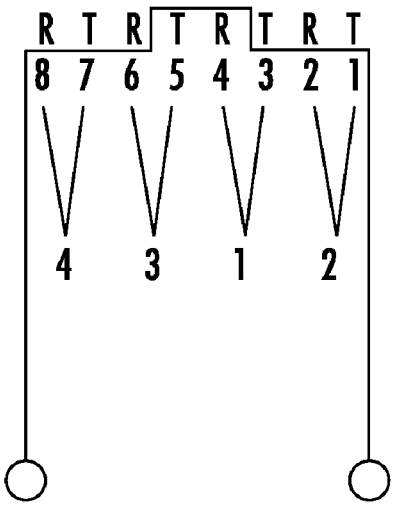
FIGS. 13A, 13B, 13C, and 13D are diagrams of embodiments of nonstandard wiring configurations that may be preselected and implemented in the keyed modular connection system of the invention.
Figure 13B:
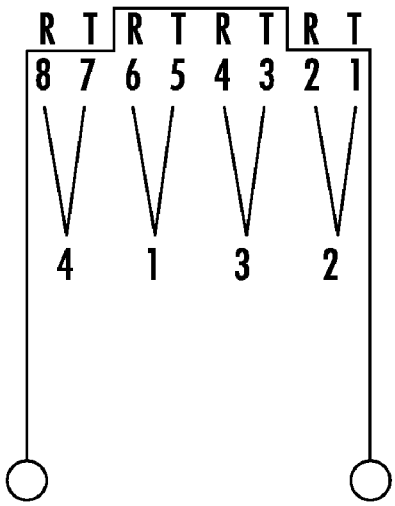
Figure 13C:
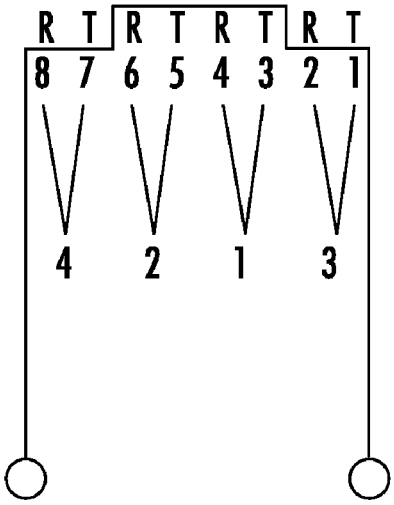
Figure 13D:
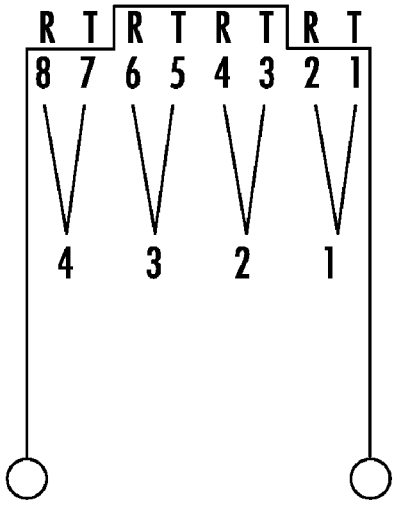

A second embodiment of the keyed modular connection system of the invention is shown broadly at reference numeral 10A in FIG. 10; the plug 11A and jack 12A of this embodiment are shown individually in FIGS. 11 and 12, respectively. In this embodiment, the sleeve protrusions 23A and the bezel recesses 25A are relocated relative to the first embodiment. This difference illustrates that the sleeve protrusions 23A and the bezel recesses 25A may appear in any one of a number of locations on the sleeve 20 and the bezel 21, respectively, so long as they remain in alignment with one another to allow the plug 11A to be received by the jack 12A.

In both embodiments, a pair of upper fingers 40 and a pair of side fingers 41 extend from the bezel 21. When the bezel 21 is installed on the jack body 22, the upper fingers 40 engage clips 42 on the jack body 22, while the side fingers 41 are received by outer recesses 43 defined by the jack body 22. Also in both embodiments, the attachment 13 serves as strain relief relative to pulling forces that may occasionally be imposed on the cabling (not shown) received by the plug 11, 11A. The cap 15 of the attachment 13 comprises a pair of side fingers 44 and an upper finger 45. When the cap 15 is installed on the sleeve 20 and the plug body 14, the pair of side fingers are received by outer recesses 50 defined by the sleeve 20 and the upper finger 45 engages a clip 51 on the plug body 14. Furthermore, the sleeve 20 comprises a pair of side fingers 52 that are received by the cap 15 when the cap 15 is installed on the sleeve 20.

The keyed modular connection system 10, 10A of the invention is designed to enable use of a preselected, nonstandard wiring configuration while assisting with preventing a user from connecting a connector component wired in the preselected, nonstandard wiring configuration to a connector component not wired in the preselected, nonstandard wiring configuration. The connection system 10, 10A thereby provides for the use of nonstandard wiring configurations while assisting with the prevention of the connection of incompatible wiring configurations and the potential damage such connection may cause. The term "nonstandard wiring configuration" as used herein refers to any wiring configuration other than TIA T568A or TIA T568B.

More specifically, the jack body protrusions 31 prevent a plug not wired in the preselected, nonstandard wiring configuration (not shown) from being inserted into the jack 12 of the disclosed embodiment of the invention, which is wired in the preselected, nonstandard wiring configuration; the bezel recesses 25, 25A have no function in this scenario, as the noncompliant plug may be inserted past them. The sleeve protrusions 23, 23A prevent the plug 11 of the disclosed embodiment of the invention, which is wired in the preselected, nonstandard wiring configuration, from being inserted into a jack not wired in the preselected, nonstandard wiring configuration (not shown); the plug body recesses 33 have no function in this scenario, as the noncompliant jack has no jack body protrusions 31 to be received by the plug body recesses 33 and in any event the plug 11 would be prevented from being inserted far enough into the noncompliant jack for the plug body recesses 33 to come into play.

The keyed modular connection system 10, 10A of the invention helps to enable safe implementation and use of any one of a number of nonstandard wiring configurations.

Nonstandard wiring configurations may help provide improved connector performance, for instance by reducing crosstalk. FIGS. 13A, 13B, 13C, and 13D each illustrate an embodiment of a nonstandard wiring configuration that may be preselected and implemented in the keyed modular connection system 10, 10A of the invention. In FIGS. 13A, 13B, 13C, and 13D, the eight conductors in standard four-twisted-pair cable are numbered "1" through "8" from right to left with a designation of each conductor as a tip "T" or ring "R" conductor. The pairs of conductors are numbered "1" through "4" in each illustrated configuration; the primary differences among the illustrated configurations are these conductor pair numberings. For instance, while conductors "1" and "2" comprise conductor pair "2" in the configurations shown in FIGS. 13A and 13B, the same conductors comprise conductor pair "3" in FIG. 13C and conductor pair "1" in FIG. 13D.

Figure 14:
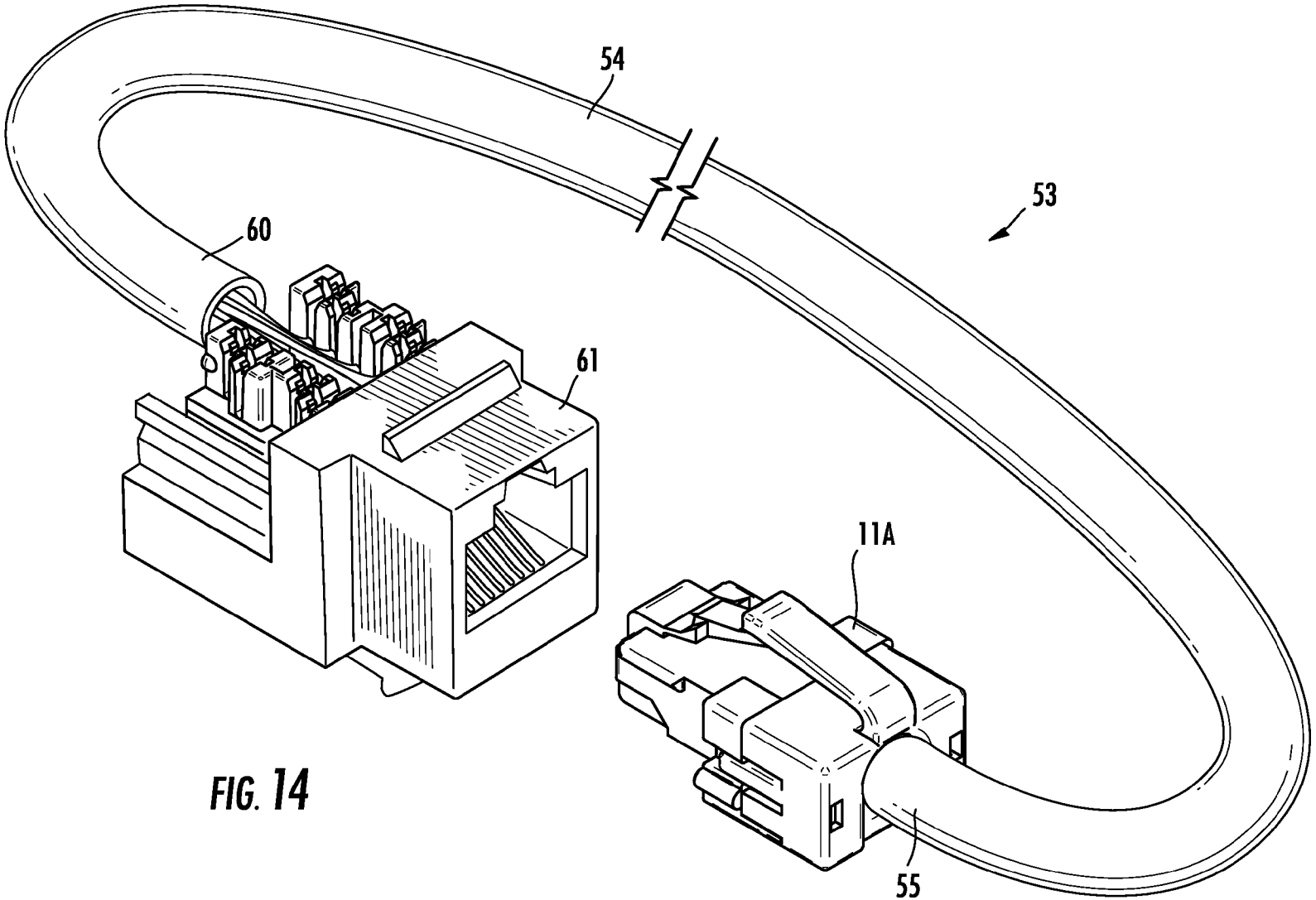
FIG. 14 is a fragmentary perspective view of an embodiment of an adapter cable according to the invention.
Figure 15:
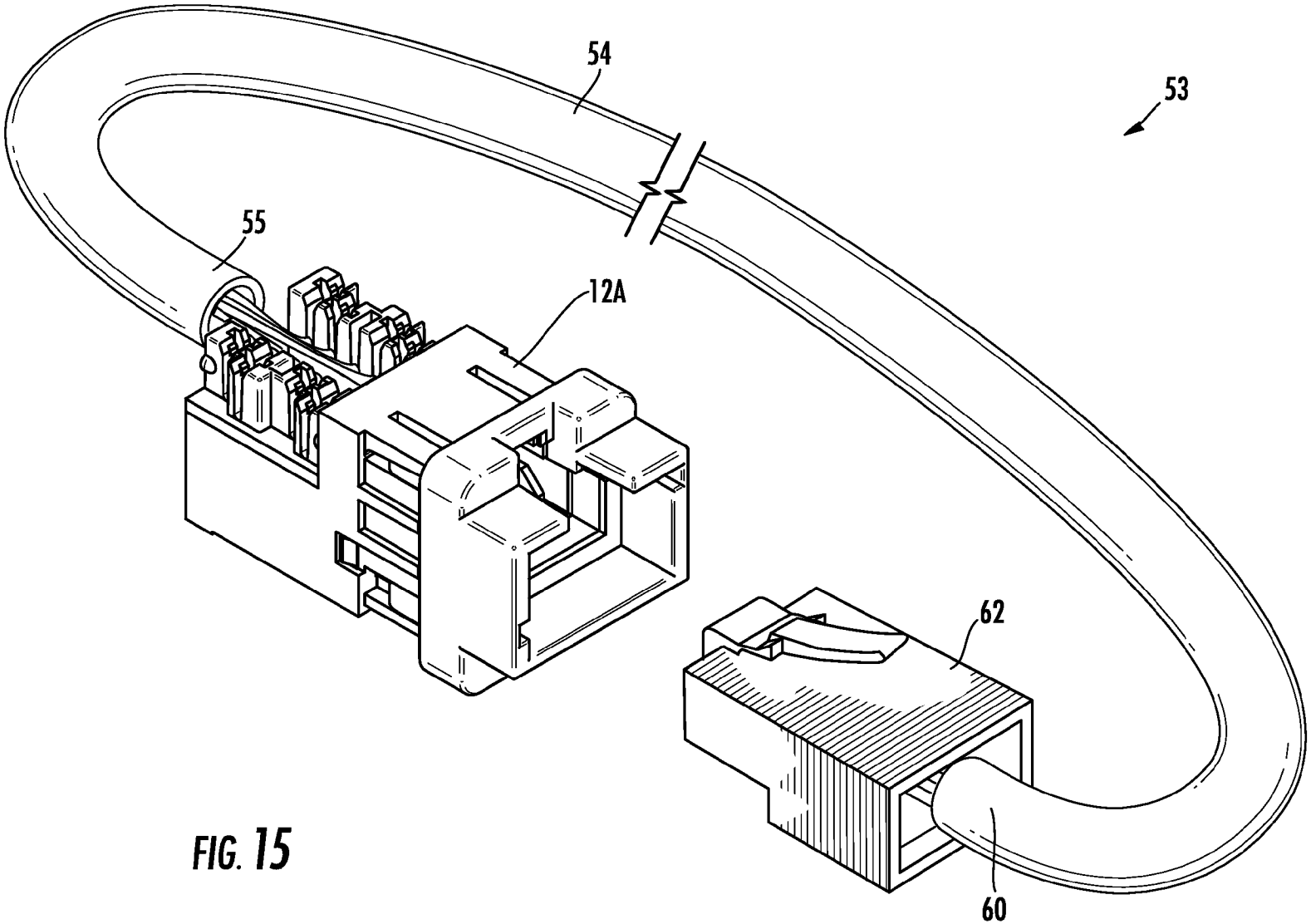
FIG. 15 is a fragmentary perspective view of another embodiment of an adapter cable according to the invention.

As shown in FIGS. 14 and 15 the invention further encompasses an adapter cable 53 to enable the user to transition between the preselected, nonstandard wiring configuration implemented in the keyed modular connection system 10, 10A of the invention and a wiring configuration other than the preselected, nonstandard wiring configuration. The adapter cable 53 is a length of cable 54 with first and second opposing ends 55, 60. The plug 11, 11A or the jack 12, 12A of the keyed modular connection system 10, 10A of the invention is attached to the first end 55 of the length of cable 54, and attached to the second end 60 of the length of cable 54 is a plug or jack not wired in the preselected, nonstandard wiring configuration implemented in the plug 11, 11A or the jack 12, 12A attached to the first end 55 of the length of cable 54. Thus, there are four embodiments of the adapter cable: a first embodiment (FIG. 14) with the plug 11, 11A (shown as 11A) attached to the first end 55 of the length of cable 54 and a jack 61 not wired in the preselected, nonstandard wiring configuration of the plug 11, 11A attached to the second end 60 of the length of cable 54, a second embodiment (not shown) with the plug 11, 11A attached to the first end of the length of cable and a plug not wired in the preselected, nonstandard wiring configuration of the plug 11, 11A attached to the second end of the length of cable, a third embodiment (not shown) with the jack 12, 12A attached to the first end of the length of cable and a jack not wired in the preselected, nonstandard wiring configuration of the jack 12, 12A attached to the second end of the length of cable, and a fourth embodiment (FIG. 15) with the jack 12, 12A (shown as 12A) attached to the first end 55 of the length of cable 54 and a plug 62 not wired in the preselected, nonstandard wiring configuration of the jack 12, 12A attached to the second end 60 of the length of cable 54.

A keyed modular connection system and associated adapter cable are described above. Various details of the invention may be changed without departing from its scope. Furthermore, the foregoing description of embodiments of the invention and the best mode for practicing the invention are provided for the purpose of illustration only and not for the purpose of limitation—the invention being defined by the claims.

What is claimed is:

1. A keyed modular connection system, comprising:

a preselected nonstandard wiring configuration;

a plug wired in the preselected nonstandard wiring configuration and comprising exterior surfaces, at least one of said exterior surfaces defining a plug recess;

a jack wired in the preselected nonstandard wiring configuration and comprising interior surfaces, at least one of said interior surfaces defining a jack recess;

a plug protrusion extending from at least one of the exterior surfaces of the plug and configured to be received by the jack recess when the plug is inserted into the jack;

a jack protrusion extending from at least one of the interior surfaces of the jack and configured to be received by the plug recess when the plug is inserted into the jack;

wherein when a plug not wired in the preselected nonstandard wiring configuration is attempted to be inserted into the jack, the jack protrusion prevents the attempted insertion, and when the plug is attempted to be inserted into a jack not wired in the preselected nonstandard wiring configuration, the plug protrusion prevents the attempted insertion.

2. A keyed modular connection system according to claim 1, wherein the jack protrusion is oriented further within the jack than the jack recess.

3. A keyed modular connection system according to claim 1, wherein the exterior surfaces of the plug comprise two opposing exterior surfaces, a plug recess is defined by each of the two opposing exterior surfaces of the plug, and a plug protrusion extends from each of the two opposing exterior surfaces of the plug.

4. A keyed modular connection system according to claim 1, wherein the interior surfaces of the jack comprise two opposing interior surfaces, a jack recess is defined by each of the two opposing interior surfaces of the jack, and a jack protrusion extends from each of the two opposing interior surfaces of the jack.

5. A keyed modular connection system according to claim 4, wherein the jack protrusions are oriented further within the jack than the jack recesses.

6. A keyed modular connection system, comprising:

a preselected nonstandard wiring configuration;

a plug wired in the preselected nonstandard wiring configuration and comprising two opposing exterior surfaces, each of said two opposing exterior surfaces defining a plug recess;

a jack wired in the preselected nonstandard wiring configuration and comprising two opposing interior surfaces, each of said two opposing interior surfaces defining a jack recess;

two plug protrusions, one extending from each of the two opposing exterior surfaces of the plug, said two plug protrusions configured to be received by the two jack recesses when the plug is inserted into the jack;

two jack protrusions, one extending from each of the interior surfaces of the jack, said two jack protrusions configured to be received by the two plug recesses when the plug is inserted into the jack;

wherein when a plug not wired in the preselected nonstandard wiring configuration is attempted to be inserted into the jack, the jack protrusions prevent the attempted insertion, and when the plug is attempted to be inserted into a jack not wired in the preselected nonstandard wiring configuration, the plug protrusions prevent the attempted insertion.

7. A keyed modular connection system according to claim 6, wherein the jack protrusions are oriented further within the jack than the jack recesses.

8. An adapter cable, comprising:

a length of cable comprising first and second opposing ends;

a plug attached to the first end of the length of cable, wired in a preselected nonstandard wiring configuration, and comprising exterior surfaces, at least one of said exterior surfaces defining a plug recess;

a plug protrusion extending from at least one of the exterior surfaces of the plug; and a connector attached to the second end of the length of cable but not wired in the preselected nonstandard wiring configuration.

9. An adapter cable according to claim 8, wherein the connector is a plug.

10. An adapter cable according to claim 8, wherein the connector is a jack.

11. An adapter cable, comprising:

a length of cable comprising first and second opposing ends;

a jack attached to the first end of the length of cable, wired in a preselected nonstandard wiring configuration, and comprising interior surfaces, at least one of said interior surfaces defining a jack recess;

a jack protrusion extending from at least one of the interior surfaces of the jack;

a connector attached to the second end of the length of cable but not wired in the preselected nonstandard wiring configuration.

12. An adapter cable according to claim 11, wherein the connector is a plug.

13. An adapter cable according to claim 11, wherein the connector is a jack.

* * * * *